US006493993B1

(12) United States Patent
Serano

(10) Patent No.: US 6,493,993 B1
(45) **Date of Patent: *Dec. 17, 2002**

(54) GUTTER PROTECTOR

(75) Inventor: Kathleen Serano, Philadelphia, PA (US)

(73) Assignee: SeranCo, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/277,544

(22) Filed: Mar. 29, 1999

Related U.S. Application Data

(63) Continuation-in-part of application No. 08/839,506, filed on Apr. 14, 1997, now Pat. No. 5,911,659.

(51) Int. Cl.[7] ..... E04D 13/064; E04D 13/076
(52) U.S. Cl. ..... 52/12; 52/11
(58) Field of Search ..... 52/11, 12

(56) References Cited

U.S. PATENT DOCUMENTS 4,592,174 A * 6/1986 Hileman ..... 52/12
4,607,465 A * 8/1986 Hopkins ..... 52/12
4,905,427 A * 3/1990 McPhalen ..... 52/12
5,595,027 A * 1/1997 Vail ..... 52/12
5,911,659 A * 6/1999 Serano ..... 52/12

* cited by examiner

*Primary Examiner*—Carl D. Friedman
*Assistant Examiner*—Yvonne M. Horton

(57) ABSTRACT

A gutter protector for preventing leaves and other debris from entering into a gutter that fits independently into standard gutter without fasteners such as nails or screws or any attachment to the roof, fascia or any other part of the building. The gutter protector consists of an inner wall which fits against the rear wall of standard gutter while seated upon the bottom wall of the gutter and a curved section that allows water to flow over the flat portion of the gutter protector through a uniform space between the gutter protector and the gutter created by a clip in the gutter protector which attaches to the gutter. The uniform space does not allow leaves or other debris larger than said uniform space to enter the gutter but maintains a space for a constant flow of water into the gutter.

7 Claims, 8 Drawing Sheets

GUTTER PROTECTOR

This application is a CIP of Ser. No. 08/839,506 filed Apr. 14, 1997, now U.S. Pat. No. 5,911,659.

FIELD OF THE INVENTION

This invention relates to a gutter protector. In particular, this invention relates to a gutter protector that fits independently into standard gutters without fasteners such as nails or screws and deflects debris away from gutters while permitting water to flow into the gutters.

BACKGROUND OF THE INVENTION

Traditional gutters trap and accumulate debris from trees, animals and other sources. Accumulated debris severely reduces the ability of gutters to properly transfer water from the roof of a structure to locations away from the foundation of the structure, thereby defeating the fundamental purpose of gutters. Accordingly, debris accumulation in gutters necessitates periodic maintenance to remove debris and return gutters to operational condition.

Various attempts have been made to alleviate debris accumulation in gutters. Each attempt, however, has provided either expensive, impractical designs or fails to provide systems easily and securely integrated into standard, existing gutters. None of the patents that follow are for gutter protectors that fit independently into standard gutter without attachment to the roof or structure or failed to propose a gutter protector capable of maintaining a uniform space between the gutter protector and standard gutter, or proposed expensive, complicated, or impractical spacing methods: U.S. Pat. Nos. 4,404,775; 4,435,925; 4,497,146; 4,796,390; 5,181,350; 5,375,379; and 5,459,965. For example, the device proposed in the '775 patent either provides no manner for maintaining a constant water flow passage between the device and gutter, or requires a separate, complicated support bracket. Similarly, none of the devices in U.S. Pat. No. 181, 375 or 459 allow for a constant water flow into the gutter.

The following patents failed to propose a gutter protector capable of adequately protecting the gutter from debris accumulation and/or required fasteners such as nails or screws to attach the gutter protector to the roof, fascia or other part of the structure to maintain the protective cover in place above the gutter and to provide a constant flow of water into the gutter: U.S. Pat. Nos. 546,042; 836,012; 891,405; 2,672,832; 4,455,791; 4,604,837; and 5,406,755. For example, the device proposed in the '042 patent would trap debris where the shield meets the gutter, thereby preventing water flow into the gutter. Of the above patents, the following require fasteners for attachment of the gutter protector to the roof, fascia or other portion of the structure in order to maintain the protective cover of the gutter protector above the gutter and to provide a constant flow of water into the gutter: '925, '837, and '755, Therefore, there is a great and thus unsatisfied demand for an inexpensive, uncomplicated, and effective gutter protector for use with standard gutters.

OBJECTS OF THE INVENTION

Accordingly, it is an object of the invention to overcome the problems associated with devices proposed in the prior art.

It is another object of the invention to provide a gutter protector made from one piece of material that is capable of deflecting debris away from the gutter while directing water flow into the gutter.

It is another object of the invention to provide a gutter protector that fits independently into standard gutters without the need for fasteners such as nails or screws for attachment to the roof, the fascia or any other part of the structure.

It is another object of the invention to provide a gutter protector which maintains a constant and adequate path for water flow into the gutter while deflecting debris away from the gutter.

Other objects of the invention will be apparent to one of skill in this art in view of the description that follows:

SUMMARY OF THE INVENTION

This invention provides a one-piece gutter protector which deflects debris away from the gutter while permitting water to flow into the gutter and fits independently into standard gutters without fasteners such as nails or screws for attachment to the roof, fascia or any other part of the structure. The gutter protector fits into a standard gutter and includes a rear portion which fits against at least a part of the rear wall of a standard gutter. The lower edge of the rear portion rests upon the bottom wall of the gutter and a curved portion that extends to and above the lip of the gutter, clips onto the lip and deflects debris away from the gutter but allows water to flow into the gutter.

The shape of the gutter protector maintains a constant and adequate path for water to flow from the roof into the gutter. A clip formed as part of the curved portion of the gutter protector enables the gutter protector to rest upon and be supported by standard gutters and maintain a constant path for water to flow to the interior of the gutter independently without the need for separate and complicated brackets or fasteners such as nails or screws that are attached to the roof, fascia or any part of the structure. The rear portion of the gutter protector fits against at least a part of the rear wall of the gutter while contacting the bottom wall of the gutter and does not require attachment to the fascia, roof or structure to maintain the protective cover over the gutter while allowing a constant flow of water into the gutter.

DETAILED DESCRIPTION OF THE INVENTION

Figure 1:
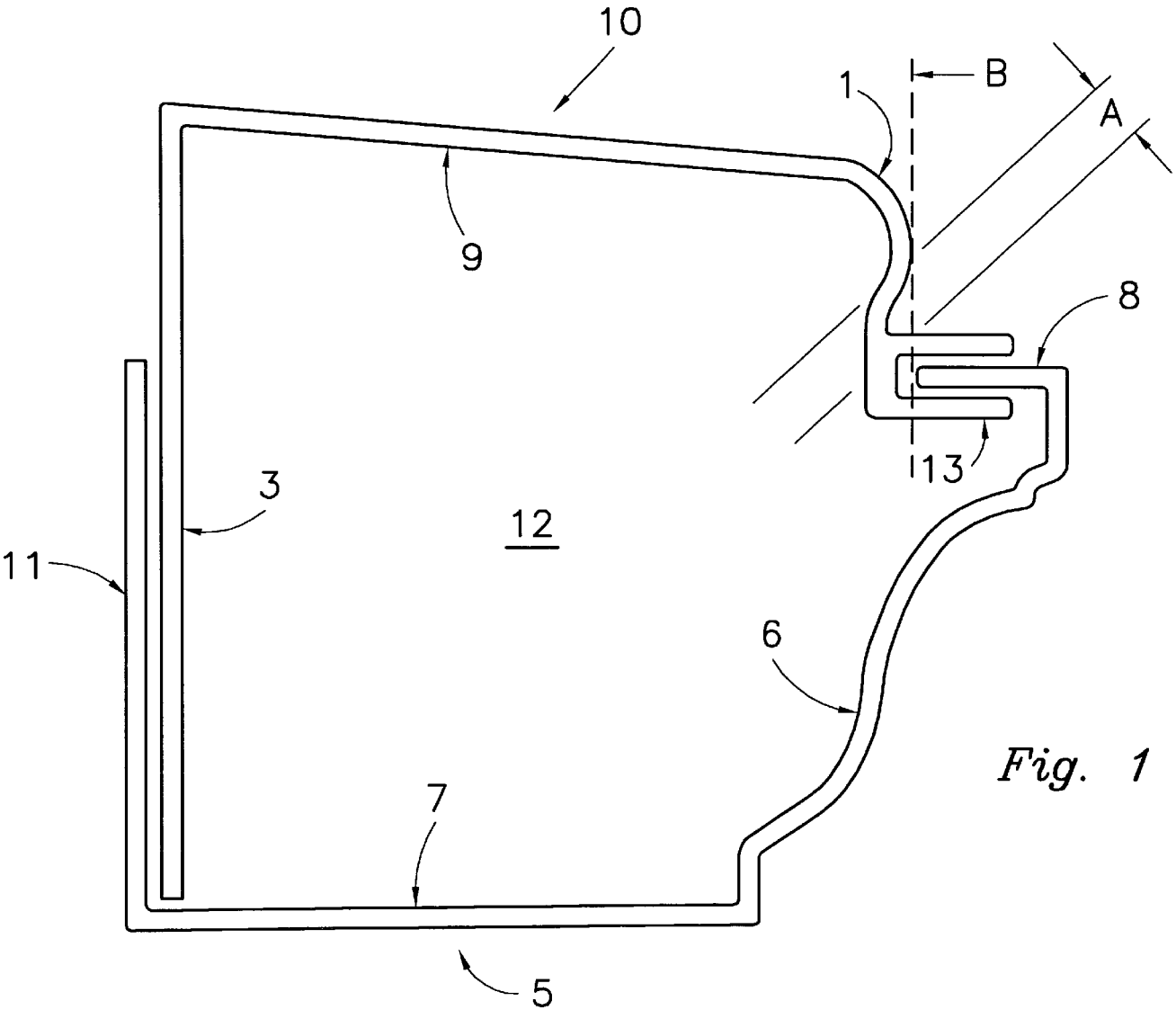
FIG. 1 is an alternative cross-sectional view of a gutter protector according to the invention shown seated in a standard K gutter.

The following description is intended to refer to the specific embodiments illustrated in the drawings. This description is not intended to define or limit the scope of the invention, which is defined separately in the claims that follow.

Referring to FIG. 1, the numeral "10" designates an embodiment of the gutter protector according to this invention. Gutter protector 10 is shown seated in the gutter designated by the numeral "5." Gutter 5 is a standard gutter trough commonly known as K gutter and used in the commercial and residential building industry. Gutter 5 has an interior space designated "12," and is defined by a rear wall 11, an outer wall 6 which extends to lip 8 and a bottom wall 7 connecting rear wall 11 to outer wall 6.

Details of gutter protector 10 are described with reference to FIGS. 1, 2, 2A, 3, 4 and 4A below and details of gutter protector 20 are described with reference to FIGS. 5 and 6 below:

FIG. 1 illustrates an important feature of the invention wherein a curved portion 1 of gutter protector 10 extends up to and above lip 8 curving toward the interior of the gutter and its final outward curve back toward lip 8 ending as clip 13 which attaches to lip 8. Curved Portion 1 allows water to flow over the gutter protector into gutter 5. This feature eliminates possible grooves, troughs, creases or channels between gutter protector 10 and the gutter where debris can collect. Space A is created above lip 8 of gutter 5 by the lowest extension of curved portion 1 designated clip 13 that attaches to lip 8, which secures gutter protector 10's position above lip 8 and maintains a space through which water can flow into the interior of the gutter. Alternatively, clip 13 may be formed along the lower longitudinally extending edge of curved portion 1 as illustrated in FIG. 4A. The smooth surface of flat portion 9 maintains the flow of water from rear portion 3 to curved portion 1. The outermost extent of curved portion 1 over gutter 5 coincides with the inner edge of lip 8 at dashed line B so that water following the contour of curved portion 1 flows into the gutter. However, debris such as leaves and tree branches larger than the space thus created above the gutter is deflected away from the gutter because said debris cannot physically pass through such limited space A into the gutter. Debris small enough to travel with water through said space A passes harmlessly with the water into the gutter and through the entire roof drainage system. The space created by curved portion 1 above gutter 5 and by the curvature of curved portion 1 allows water flowing along flat portion 9 to contour and fall over curved portion 1 of gutter protector 10 into gutter 5.

Figure 2:
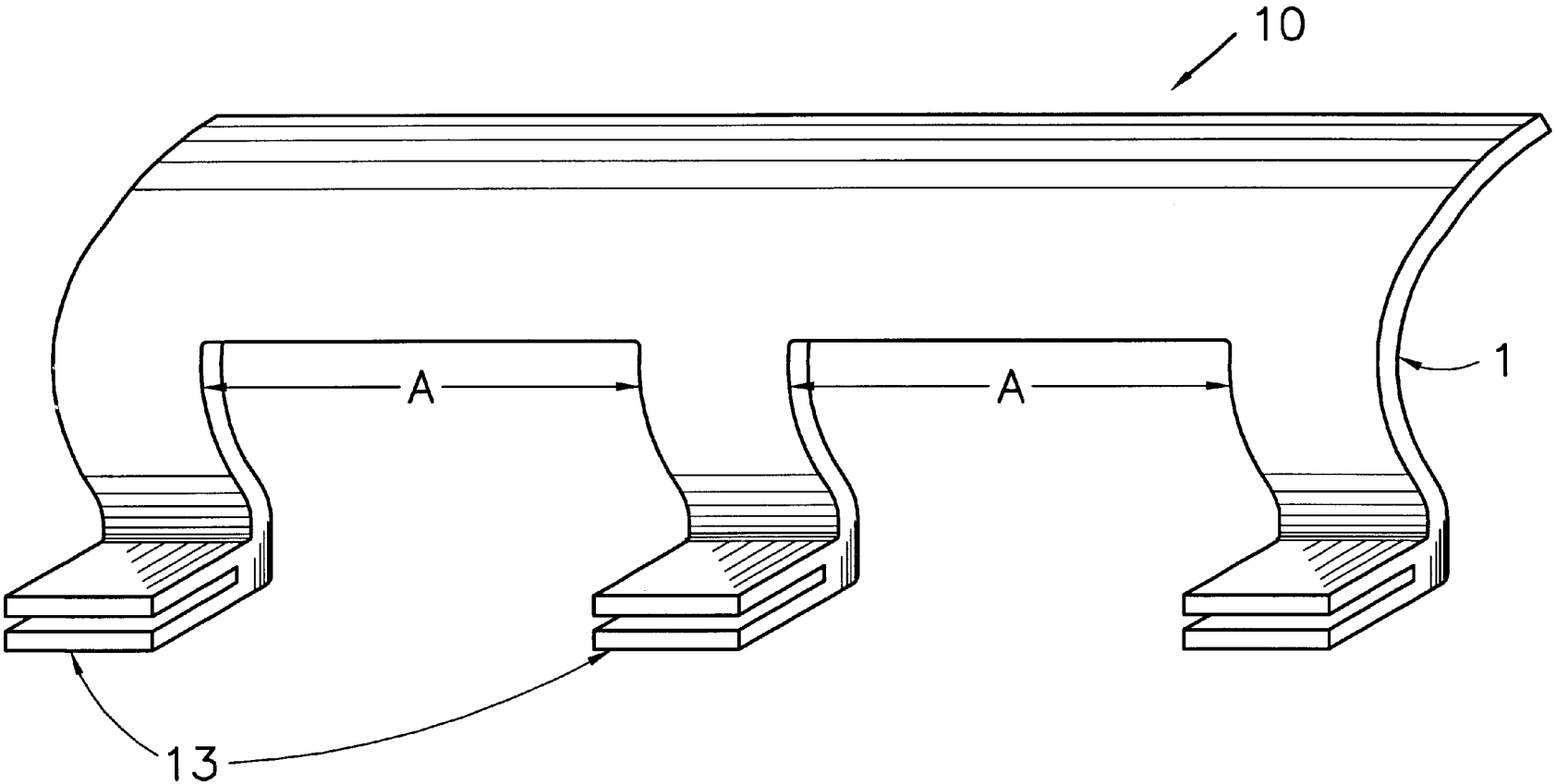
FIGS. 2 & 2A are front views of a clip which fits onto the outer edge or lip of a standard K gutter and provides an opening for water to flow into the gutter.
Figure 2A:
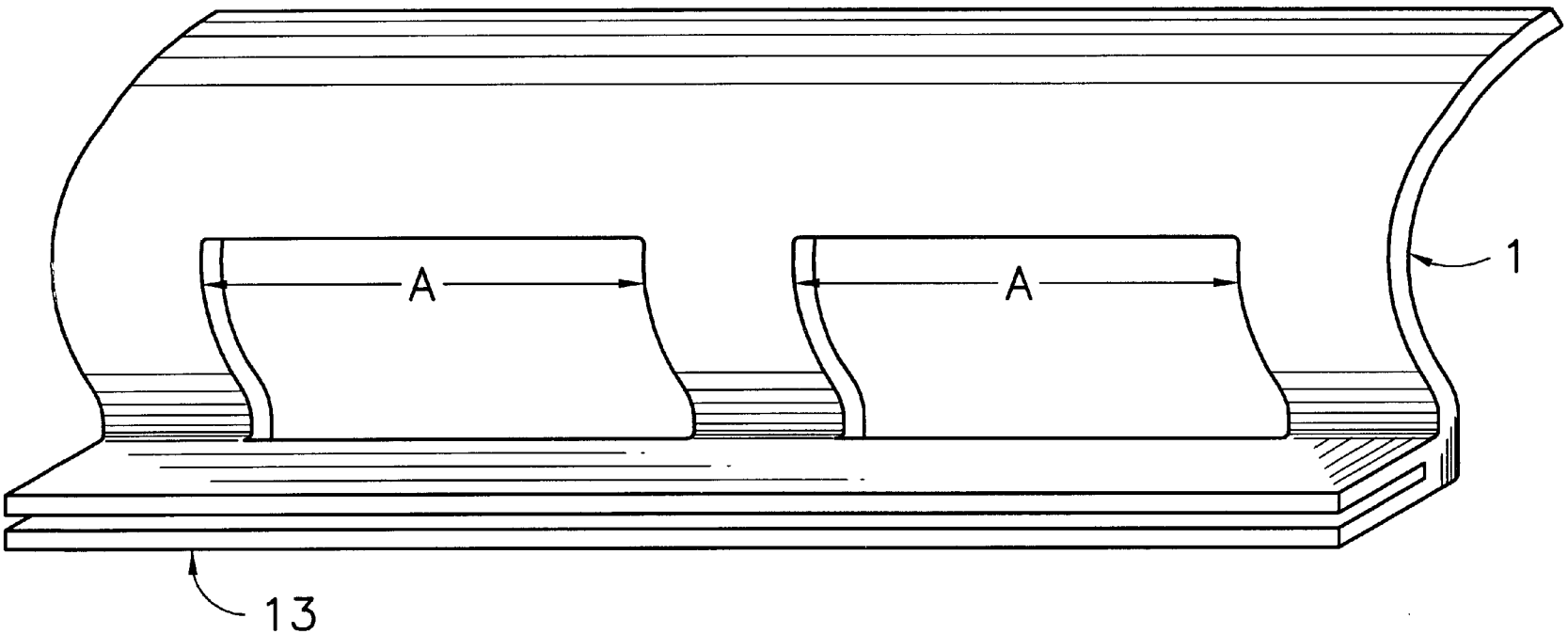

FIGS. 2 & 2A are alternate front views illustrating two variations of curved portion 1 of gutter protector 10 which depict space A and clip 13. Utilization of either variation depends upon the manufacturer's preference. If plastic is used to form gutter protector 10, gutter protector 10 will easily be strong enough to support the weight of the environmental elements such as snow, ice and rain.

Figure 3:
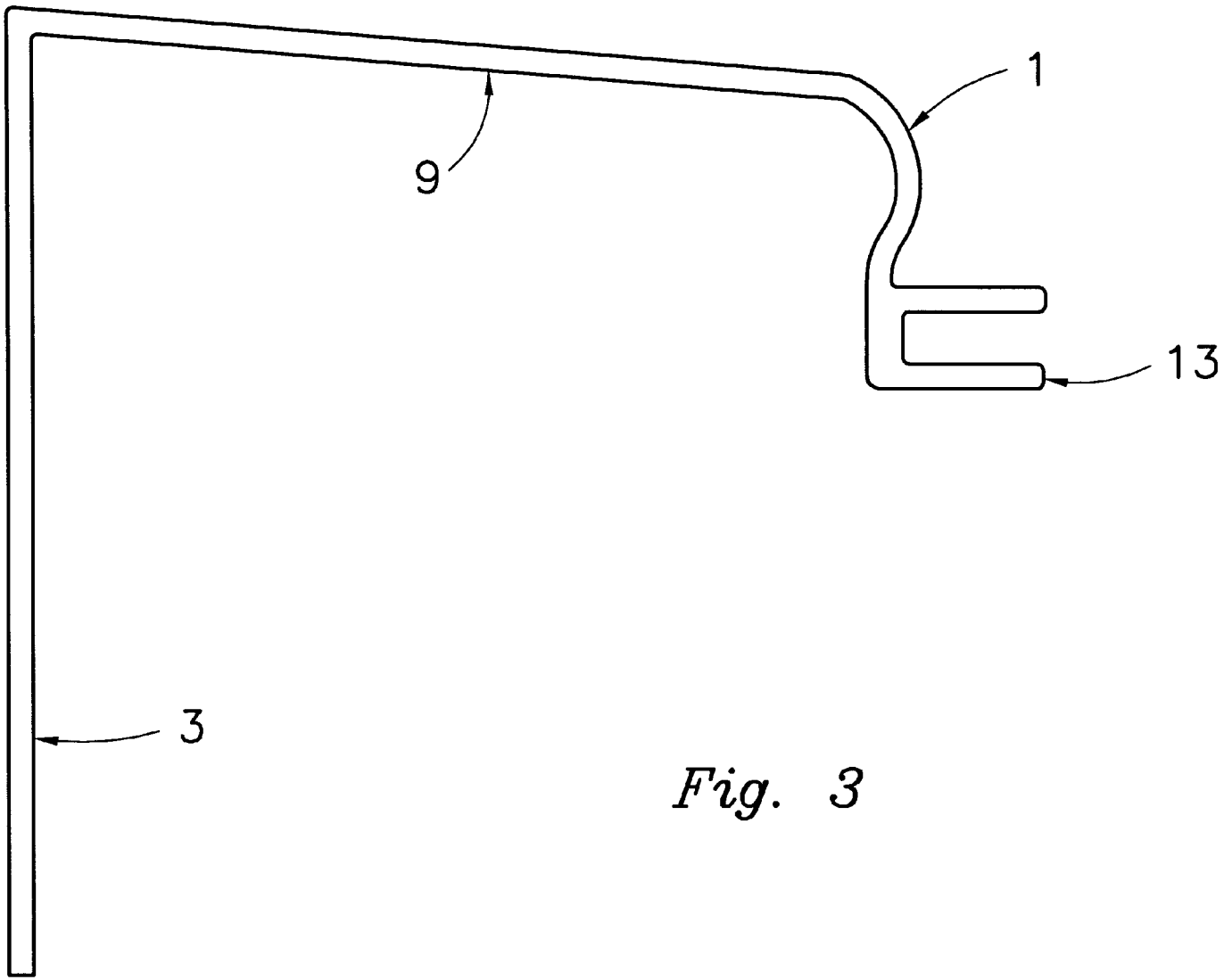
FIG. 3 is a side view of the gutter protector shown in FIG. 1.

FIG. 3 shows gutter protector 10 from the side, illustrating its important contour. Specifically, FIG. 3 shows gutter protector 10's rear portion 3 and its slightly greater than 90 degree angle to flat portion 9 which proceeds laterally to and above the gutter becoming curved portion 1 which curves toward the interior of the gutter and then curves outwardly forming clip 13. The angle where rear portion 3 meets flat portion 9 is slightly greater than 90 degrees in order to create tension between gutter protector 10's points of contact with gutter 5 at bottom wall 7 and lip 8.

Figure 4:
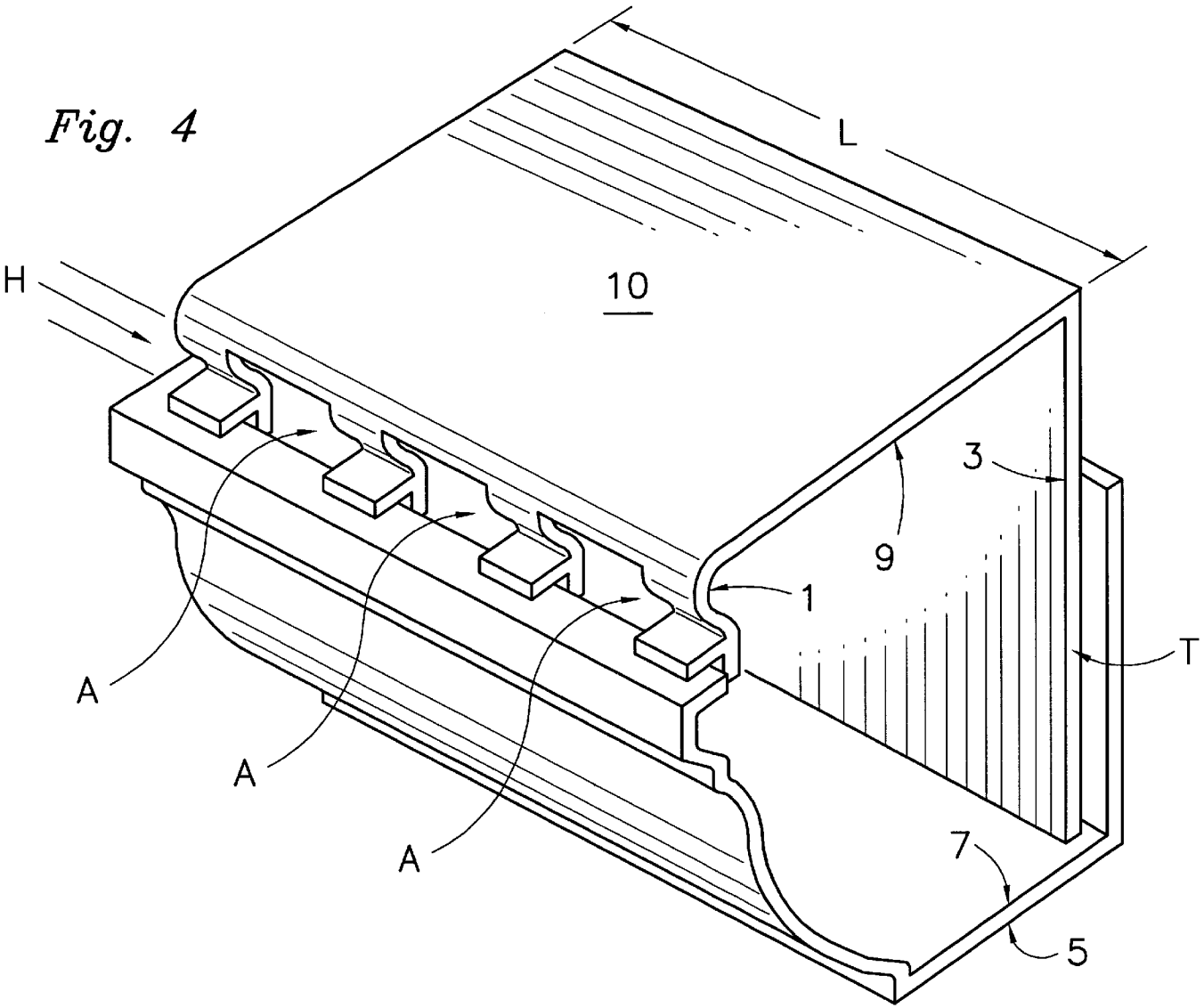
FIGS. 4 and 4A are perspective views of a gutter protector according to this invention shown positioned in a standard K gutter.
Figure 4A:
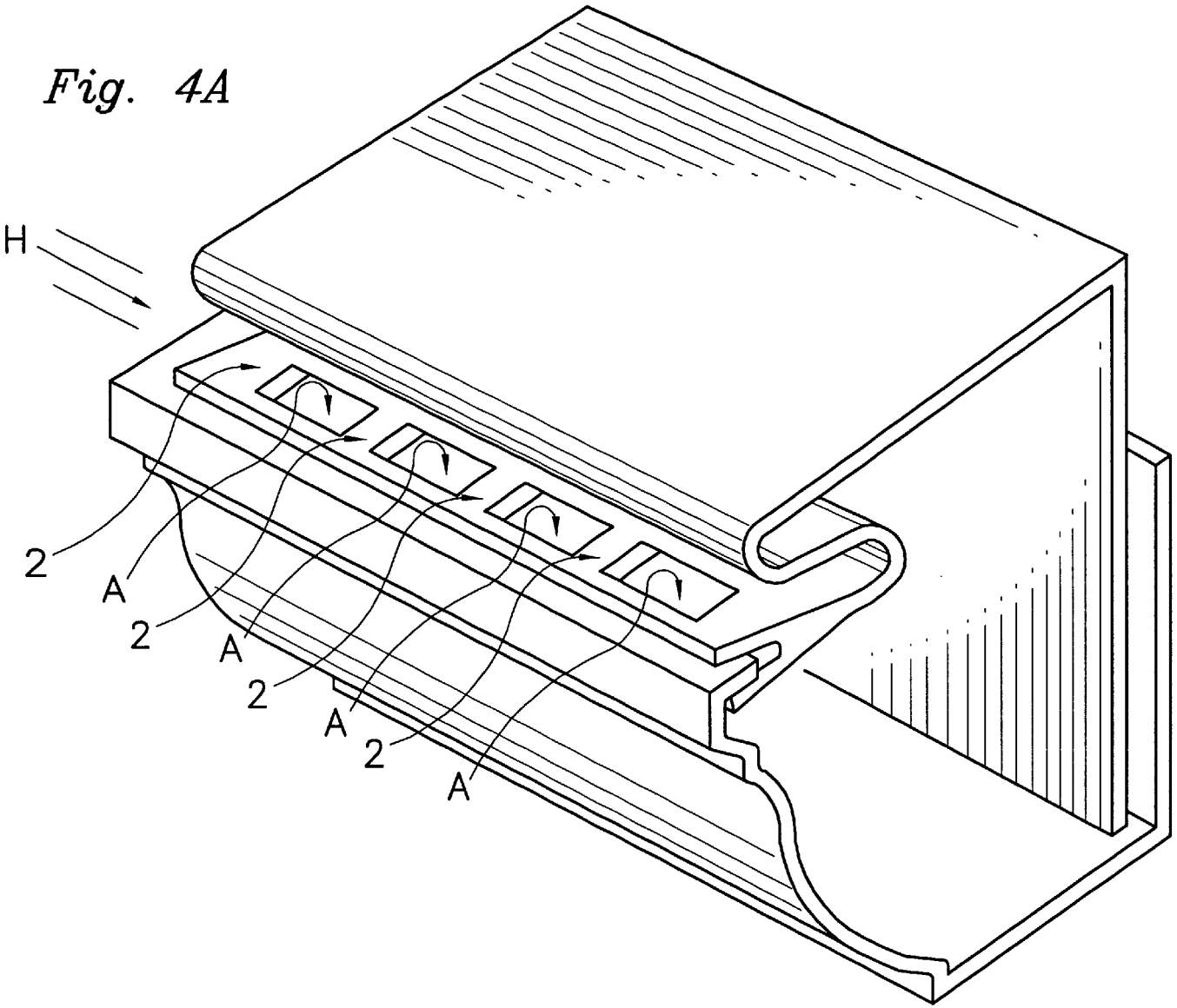

Referring to FIG. 4, gutter protector 10 has an overall length L which preferably corresponds to the length of gutter 5 in which gutter protector 10 independently fits. The upper part of rear portion 3 angles and extends laterally as flat portion 9 toward curved portion 1. Gutter protector 10 has a thickness of T sufficient to provide a rigid surface capable of withstanding environmental elements such as wind, ice and snow. Curved portion 1 creates height H forming space A which provides the space through which water may continuously flow into the gutter. Flat portion 9 and curved portion 1 of gutter protector 10 most preferably have a smooth surface.

FIG. 4A is an alternative view illustrating a variation of curved portion 1 where clip 13 is formed at its lower longitudinally extending edge with space A created through cutouts in curved portion 1. FIG. 4A also illustrates curved portion 1's inner curve toward the interior of gutter 5, its outward curve toward lip 8 and the contact of clip 13 with lip 8 of gutter 5 which provides strength and stability.

Figure 5:
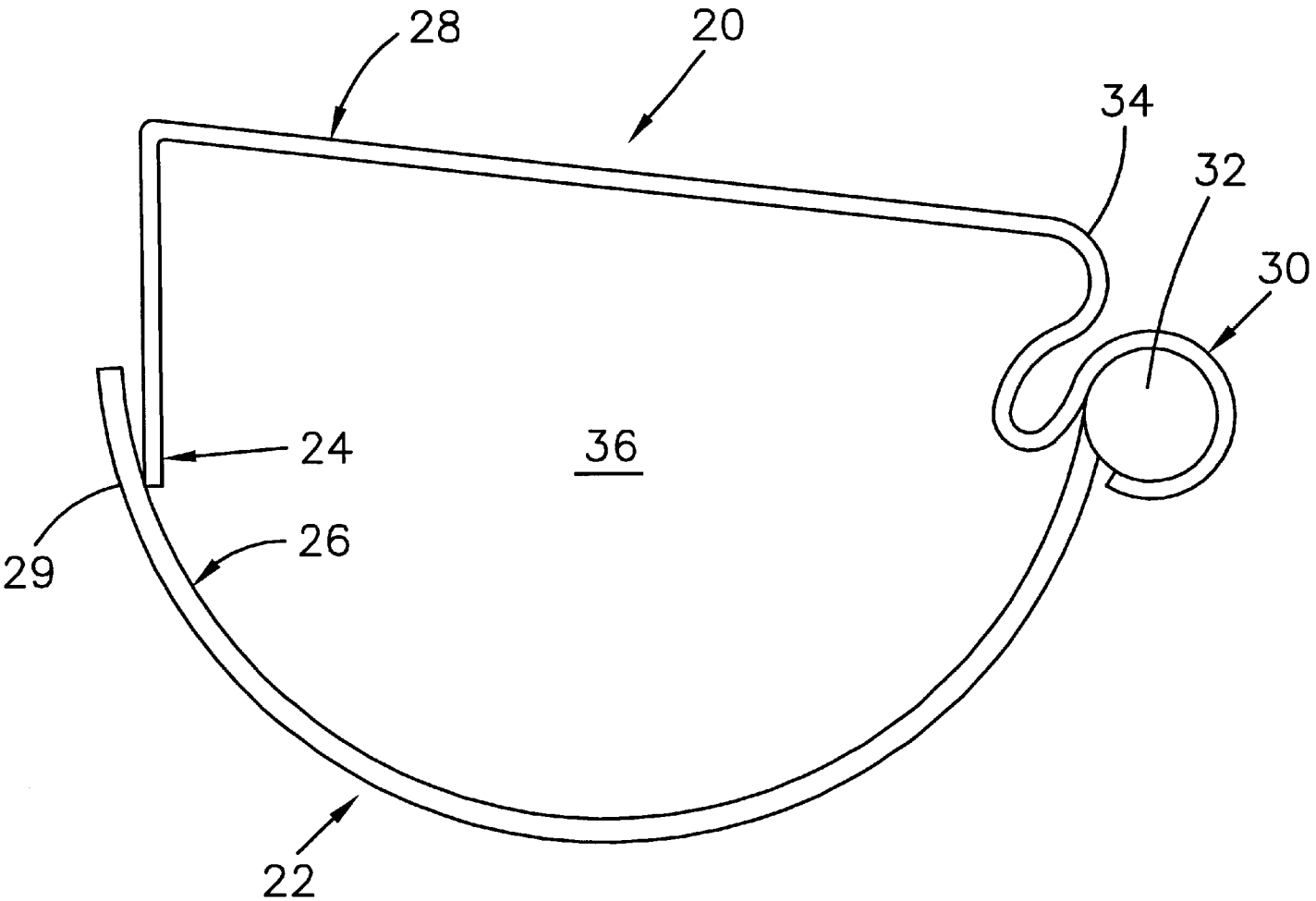
FIG. 5 is a cross-sectional view of another embodiment of a gutter protector according to this invention shown positioned in a standard half-round gutter.

FIG. 5 shows another embodiment of a gutter protestor in accordance with aspects of this invention. The gutter protector 20 in FIG. 5 is similar to and performs the same function as gutter protector 10, previously described. It is different in certain aspects in order to fit into another type of standard gutter typically known as half-round gutter. Such half-round gutters are of an older design and do not contain the discrete sidewalls 5, 6 and 7 shown in the K-gutter of FIG. 1. Lower portion 24 of gutter protector 20 engages inner surface 26 of gutter 22 at a location proximate to side 29 where gutter 22 connects to or is mounted to the outer fascia of a structure. The exact point where lower portion 24 engages inner surface 26 is not particularly important so long as sloped portion 28 of gutter protector 20 maintains a "downhill" slope proceeding from left to right as shown in FIG. 5.

Another difference of gutter protector 20 as shown in FIG. 5 from gutter protector 10 as shown in FIG. 1 is that clip 13 of gutter protector 10 has been changed to fit rounded gutter 22. Specifically, clip 30 of gutter protector 20 is sized and shaped to engage lip 32 of gutter 22. Clip 30 simply surrounds and snaps over and around lip 32.

Figure 6:
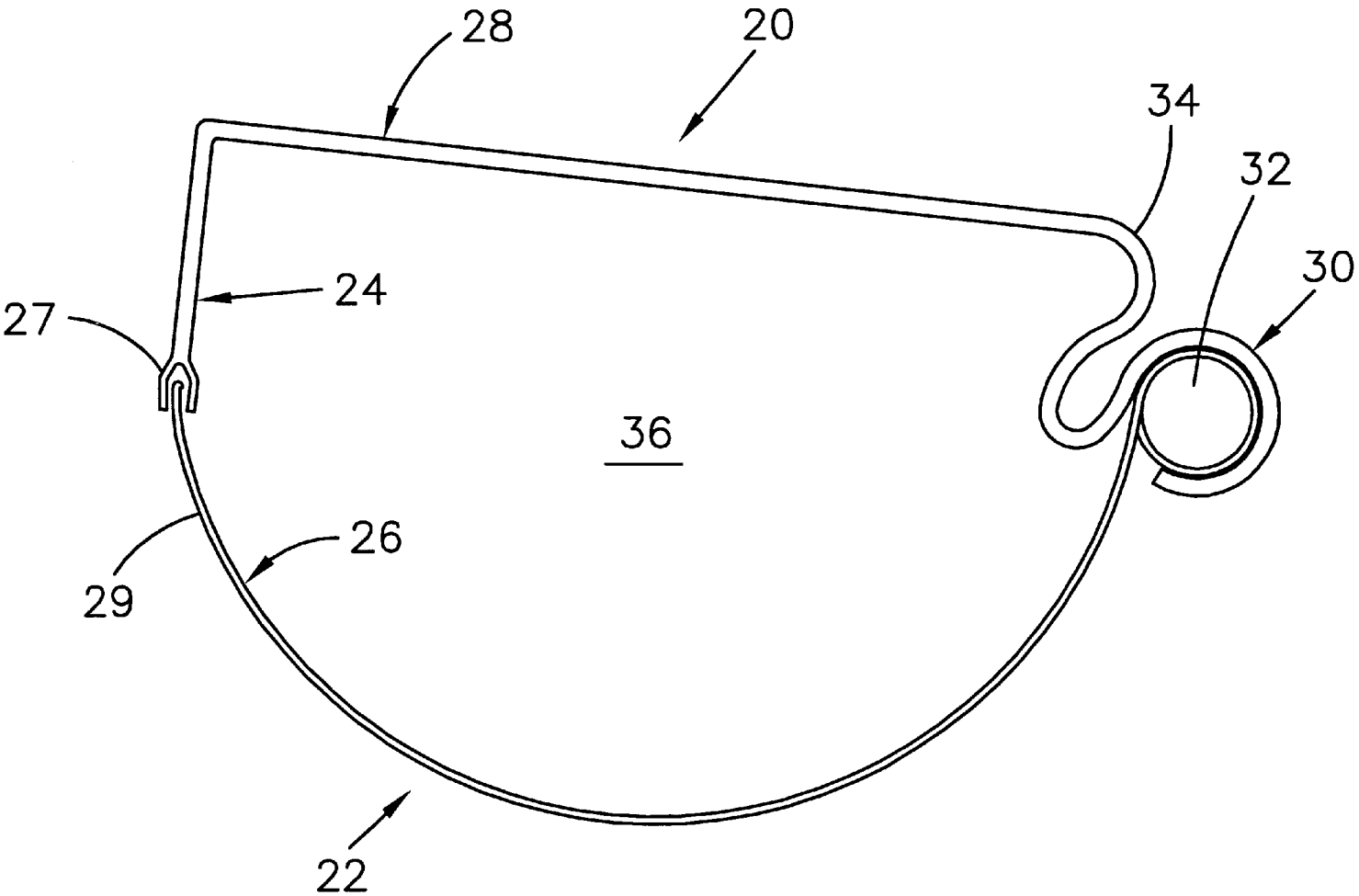
FIG. 6 is a cross-sectional view of still another embodiment of a gutter protector according to this invention shown positioned in a standard half-round gutter.

FIG. 6 shows yet another embodiment of a gutter protector in accordance with this invention adapted to fit into half-round gutters. Gutter protector 20 in FIG. 6 is similar to that shown in FIG. 5 except that lower portion 24 from FIG. 5 has been supplemented with forked groove 27 that engages the upper edge of side 29. The remaining structural portions of gutter protector 20 are the same as shown in FIG. 5.

Other aspects of the structure and operation of gutter protector 20 from FIGS. 5 and 6 remain the same as gutter protector 10 in FIG. 1. Thus, water flows from the roof of the structure onto sloped portion 28, travels over curved portion 34 and flows downwardly through a space (not shown) similar to space A in FIGS. 1, 2, 2A, 4 and 4A. Of course, leaves, debris and the like do not enter the interior portion 36 of gutter 22.

Gutter protector 10 and 20 are preferably formed from malleable materials such as plastic, fiberglass, composite material or other suitable ultraviolet resistant materials, depending upon the manufacturer's preference. However, gutter protector 10 and 20 are optionally formed from aluminum, copper, stainless steel, alloys or other metallic materials commonly used in building gutter systems.

Installation and operation of gutter protector 10 will now be described with reference to FIGS. 1–4A. As one contiguous piece, gutter protector 10 fits independently into standard K gutter without fasteners for attachment to the fascia, roof or any other part of the structure. Alternately, rear portion 3 may fit against any part of rear wall 11 or may not contact rear wall 11 at all. However, the linear lower longitudinally extending edge of rear portion 3 must contact bottom wall 7 of gutter 5. Referring to FIGS. 5 and 6, the linear lower longitudinal edge of rear portion 24 must contact bottom portion 26.

Two parts of gutter protector 10 in FIGS. 1–4A contact gutter 5 consisting of (1) rear portion 3 contacting at least a part of rear wall 11 of gutter 5 while contacting bottom wall 7 of gutter 5 and (2) clip 13 of curved portion 1 contacting lip 8 of gutter 5. Gutter protector 10 is held in place by the force of gravity on the two contact points as well as the tension between rear portion 3's contact with at least a part of rear wall 11 and its contact with bottom wall 7 and the attachment of clip 13 to lip 8 of gutter 5. Similarly, two parts of gutter protector 20 contact gutter 22 in FIGS. 5 and 6 consisting of (1) rear portion 24 contacts at least a part of portion 26 of gutter 22 and (2) clip 30 of curved portion 20 contacts lip 32 of gutter 22. These two contact points provide a strong and stable union with standard gutters that is stationary and easily capable of withstanding the environmental elements of wind, rain, snow and ice.

Leaves and other debris washed by water from the roof onto gutter protector 10 seated independently in gutter 5 as illustrated in FIGS. 1, 4 and 4A are deflected away from lip 8 because of the limitations of space A created by height H. Water continuously flows over curved portion 1 of gutter protector 10 through space A created by height H into gutter 5; however, leaf fragments and debris larger than space A are deflected away from gutter 5. The following Example exemplifies the operation of a gutter protector according to this invention:

EXAMPLE

A gutter protector according to this invention was formed from Polyvinyl Chloride or PVC having a thickness of 0.085 centimeters and length of 48 inches, a rear portion fitting against at least a part of the rear wall of a standard K gutter measured 4 ¾ inches and was seated upon the bottom wall of a standard gutter, flat portion 9 proceeded laterally from the upper part of the rear portion to curved portion 1 and had an approximate length of 5 inches, curved portion 1's inward curve had a diameter of approximately ½ inch and its outward curve had a diameter of ½ inch with clip 13 attached to lip 8.

The gutter protector was inserted into standard K gutter of a roof and tap water from a hose was supplied to the roof at progressively greater flow rates of 30 gallons per hour, 45 gallons per hour, 60 gallons per hour, 90 gallons per hour and 120 gallons per hour. These flow rates represent the flow of rainwater over the four-foot length of the gutter protector. Even at the highest rate of 120 gallons per hour per four-foot section of gutter protector, simulated rainwater followed the contour of curved portion 1 and flowed into the gutter. This indicates that rainwater, even during severe thunderstorms, will follow the contour of the gutter protector and flow through the space designated space A created by height H of curved portion 1 into the gutter while debris larger than ⅜ inch is deflected away from the gutter.

If desired, changes and modifications can be made to the illustrated embodiment of this invention without departing from its spirit and scope. For example, spacers may alternately be attached to curved portion 1 instead of being formed from the same material used to manufacture gutter protector 10. Such attached spacers may be connected or fastened to gutter protector 10 by any means known in the art and may be made from the same or different material. As another example, clip 13 may contact lip 8 longitudinally with space for water to flow into the gutter made through openings in the outermost curve of curved portion 1 formed at selected intervals as illustrated in FIGS. 2A and 4A. Gutter protector 10 may be manufactured with varied dimensions of thickness and height above the gutter, so long as space is provided for water to flow into the gutter.

The present invention, in any embodiment, provides an inexpensive device for reliably preventing accumulation of debris in standard gutters. The invention is inexpensive to manufacture, simple to install, and dependable in use. Because of its unique one-piece construction and its independent fit into standard gutter systems without the need for fasteners of any kind for attachment to the fascia, roof or any other part of the structure, installation of gutter protector 10 is accomplished by simply inserting the gutter protector directly into standard K gutter with clip 13 attaching lip 8 and rear portion 3 contacting bottom wall 7 of gutter 5. Installation of gutter protector 20 is accomplished by simply inserting the gutter protector directly into standard half-round gutter with clip 30 attaching lip 32 and rear portion 24 contacting curved portion 26 of gutter 20.

What is claimed is:

1. A gutter protector that fits independently into a gutter without fasteners and is adapted to prevent debris from a roof of a building from entering a gutter and permit flow of water from said roof of said building into said gutter, said gutter having an interior defined by a rear wall, an outer wall having an upper lip, and a bottom wall connecting said inner wall to said outer wall, comprising:

a rear portion adapted to fit against at least a part of said rear wall of said gutter and having a lower edge positioned adjacent said bottom wall;

a substantially flat portion extending laterally from an upper edge of said rear portion and adapted to receive said water flowing from said roof and being sloped substantially horizontally to transfer said water away from said roof and into said gutter;

a curved portion extending downwardly from said flat portion to and above said upper lip and curving toward said interior to receive water along said flat portion and transfer said water to said interior and a clip projecting from said curved portion and being shaped to attach onto said upper lip to provide support for said curved portion and to define a space above said gutter for said water to flow from said curved portion into said interior, and means providing tension on said substantially flat portion and said curved portion between said gutter's rear wall and said clip.

2. A gutter protector comprising:

a longitudinally extending rear portion that fits against at least a part of a rear wall of a gutter and having a lower edge seated upon a bottom wall of said gutter;

a substantially flat portion extending from an upper edge of said rear portion to and above a lip extending from an outer wall of said gutter;

a curved portion extending from said flat portion to and above said lip and curving toward an interior of said gutter; and a clip projecting from said curved portion, said clip being located substantially transverse to the length of said gutter protector and shaped to attach to said lip to provide support for said curved portion and to define a space above said gutter for water to flow along said curved portion into said gutter, said substantially flat portion and said curved portion being of a size and shape to be under tension between said rear wall of said gutter and said interior of said gutter.

3. A gutter protector described in claim 2 wherein said rear portion does not contact said rear wall of said gutter and with the lower edge of said rear portion contacting said bottom wall of said gutter.

4. The gutter protector described in claim 2, wherein said clip projects outwardly from at least a part of said curved portion of said gutter protector and is shaped to attach onto the lip of said outer wall of said gutter to provide support for said gutter protector and to provide a space for rainwater to flow over said curved portion and into the interior of said gutter.

5. The gutter protector described in claim 2, wherein following its inward curve toward the interior of said gutter, the lower longitudinally extending edge of said curved portion curves outwardly to and clips onto said lip of said gutter allowing water to flow into said gutter through openings placed at selected intervals in said outward curve of said curved portion.

6. A gutter protector described in claim 2 wherein said rear portion is adapted to fit against the interior surface of a standard half-round gutter and said clip projecting from said curved portion is adapted and shaped to attach to a rounded upper lip of said standard half-round gutter.

7. A gutter protector that fits independently into a gutter without fasteners and is adapted to prevent debris from a roof of a building from entering a gutter and permit flow of water from said roof of said building into said gutter, said gutter having an interior defined by a wall having an interior surface and an upper lip, said gutter protector comprising:

a rear portion adapted to fit against said wall of said gutter and having a lower edge engaging said interior surface;

a substantially flat portion extending laterally from an upper edge of said rear portion and adapted to receive said water flowing from said roof and being sloped horizontally to transfer said water away from said roof and into said gutter;

a curved portion extending downwardly from said flat portion to and above said upper lip and curving toward said interior to receive water from said flat portion and transfer said water to said interior and a clip projecting from said curved portion and being shaped to attach onto said upper lip to provide support for said curved portion and to define a space above said gutter for said water to flow along said curved portion into said interior.

* * * * *